US012085357B2

(12) United States Patent
Alson

(10) Patent No.: US 12,085,357 B2
(45) Date of Patent: Sep. 10, 2024

(54) THUMB REST ANTI-ROTATION PIN FOR A FIREARM

(71) Applicant: Joel Alson, Austin, TX (US)

(72) Inventor: Joel Alson, Austin, TX (US)

( * ) Notice: Subject to any disclaimer, the term of this patent is extended or adjusted under 35 U.S.C. 154(b) by 0 days.

(21) Appl. No.: 18/111,557

(22) Filed: Feb. 18, 2023

(65) Prior Publication Data

US 2024/0230276 A1 Jul. 11, 2024

Related U.S. Application Data

(63) Continuation-in-part of application No. 29/881,895, filed on Jan. 7, 2023, now abandoned.

(51) Int. Cl.
*F41C 23/06* (2006.01)
*F41C 23/10* (2006.01)

(52) U.S. Cl.
CPC ..... *F41C 23/06* (2013.01); *F41C 23/10* (2013.01)

(58) Field of Classification Search
CPC ..... F41C 23/06; F41C 23/10; F41C 23/16
See application file for complete search history.

(56) References Cited

U.S. PATENT DOCUMENTS 11,175,113 B1 11/2021 Chin
2017/0307327 A1 10/2017 Cross
2021/0364248 A1* 11/2021 Teague ..... F41C 23/12
2023/0013901 A1* 1/2023 Strayer ..... F41C 23/06
2023/0040664 A1* 2/2023 Coonan ..... F41C 23/04

OTHER PUBLICATIONS

Teckmat, "Glock Gen4"; downloaded from <https://tekmat.com/glock-g4/> on Jun. 12, 2024; copyrighted 2016.
Tandumcross; "Glock 'Accelerator' Thumb Rest Instalation Instructions"; v1.0; downloaded from <https://www.tandemkross.com/assets/images/Instructions/Glock17Gen4AcceleratorThumbRestInstallationInstructions.pdf> on Mar. 22, 2023; copyrighted 2023.
Cross Armory; "Thumb Grip by Cross Armory"; downloaded from <https://crossarmory.com/shop/thumb-grip/> on Mar. 22, 2023.
Agency Arms; Agency Optical Mount; downloaded from <https://www.agencyarms.com/agency-optic-mount-aom> on Mar. 22, 2023; copyrighted 2023.

(Continued)

*Primary Examiner* — J. Woodrow Eldred
(74) *Attorney, Agent, or Firm* — Gregory K. Goshorn; GREG GOSHORN, P.C.

(57) ABSTRACT

An anti-rotation thumb rest providing advantages that allow for non-destructive and unobtrusive installation on firearms that would otherwise not be able to accommodate a thumb rests. The thumb rest may be constructed by attaching or manufacturing a long cylindrical pin onto the back side of a thumb rest, as to serve as a trigger pin, locking block pin, or other pin used for securing pistol components internally together, while also providing a typically rectangular, square, circular, or irregular shaped protrusion that serves as an anti-rotation stop for installation in a typically unused recess in the firearm's receiver, that was not expressly designed for installing components.

21 Claims, 8 Drawing Sheets

(56) References Cited

OTHER PUBLICATIONS

Tooth and Nail Armory; "When You Want It, How You Want It"; downloaded from <https://www.toothandnailarmory.com/product/TN030.html> on Mar. 22, 2023; copyrighted 2012-2022.
Smart Lock Technology, Inc.; "Range Testing"; downloaded from <http://www.smartlock.com/SWThumbMagwell.htm> on Mar. 22, 2023; copyrighted 2007.
Eeman Tech; "Eeman Tech Slide Stop with THumb Rest for CZ Shadow 2—GREY"; downloaded from <https://b2b.eemann.tech/et-parts/7205-eemann-tech-slide-stop-with-thumb-rest-for-cz-shadow-2-grey.html> on Mar. 22, 2023; copyrighted 2023.
Align Tachtical; "Dominate with a Dynamic Duo"; downloaded from <https://www.aligntactical.com/pages/thumb-rest-takedown-lever/> on Mar. 22, 2023; copyrighted 2023.
Odin Armory; Odin Armory P320 Thumb Rest (Non-Folding); Version 1.0; downloaded from <https://odinarmory.com/shop/ols/products/odinarmoryp320t> on Mar. 22, 2023; copyrighted 2021.

* cited by examiner

THUMB REST ANTI-ROTATION PIN FOR A FIREARM

CROSS-REFERENCE TO RELATED APPLICATIONS

The present application is a Continuation-in-part of U.S. Design Patent Application, entitled "Thumb Rest Anti-Rotation Pin for a Firearm," Ser. No. 29/881,895, filed Jan. 7, 2023, assigned to the assignee of the present application and hereby incorporated by reference.

FIELD OF THE INVENTION

The field of the invention generally relates to firearms, and more particularly, to firearm thumb rests which attach to pistols via a forked extension comprising a cylindrical pin for the assembly of components of a pistol and its neighboring anti-rotation plug that mates within an otherwise open and unplugged receiver cavity or channel.

BACKGROUND OF THE INVENTION

Firearm thumb rests provide the operator of a firearm a resistive surface for their support hand's thumb to lock down against, mitigating the undesirable effect of muzzle-lifting recoil from the firing cycle, allowing for faster follow-up shots on target. Thumb rests are popular in competitive shooting competitions as a tool to improve performance, however the installation of these enhancements pose a challenge when retro-fitting firearms that were not designed to utilize them. This has led to the destructive and irreversible drilling and tapping the firearm's receiver or grip module for fastening a thumb rest via screws. Since most firearm lower receivers are serialized parts, there are shooters who would prefer not to permanently modify their firearm as this not only voids most warranties but may also ruin the aesthetics and/or function of the firearm. Permanent modifications can also restrict which competitive divisions a shooter can shoot in.

These issues led to the innovation of finding non-permanent attachment designs and methods for adding thumb rests to existing firearms. These include thumb rests being incorporated into replaceable firearm components such as disassembly levers, slide stops, straddling two or more assembly pins, or attaching them via 1913 Picatinny Rails that would otherwise be used for lights or lasers. However, not all firearm designs provide for a simple modification of components, many of which are often limited to positioning that impairs natural grip ergonomics, creates undesired complexity and/or aesthetics, or adds considerable bulk that makes holstering excessively difficult or impossible.

Some prior thumb rest designs include the following:

U.S. Patent application US20170307327A1, abandoned by Wes Cross with a publication date of Oct. 26, 2017, entitled "THUMB REST," which describes a competition style thumb rest that attaches via Picatinny rail.

U.S. patent Ser. No. 11/175,113B1, issued Nov. 16, 2021 to STRIKE INDUSTRIES, INC., entitled "THUMB REST AS INTEGRAL PART OF FIREARM," which describes an integrated surface feature that acts a rest for the shooter's thumb.

SUMMARY OF THE INVENTION

An anti-rotation thumb rest is disclosed herein, providing advantages that allow for non-destructive and unobtrusive installation on firearms that would otherwise not be able to accommodate a thumb rests, in accordance with embodiments of the present disclosure. These embodiments may be constructed by attaching or manufacturing a long cylindrical pin onto the back side of a thumb rest, as to serve as a trigger pin, locking block pin, or other pin used for securing pistol components internally together, while also providing a typically rectangular, square, circular, or irregular shaped protrusion that serves as an anti-rotation stop for installation in a typically unused recess in the firearm's receiver, that was not expressly designed for installing components.

As disclosed herein, an externally protruding thumb rest surface opposite of an internally insert-able cylindrical shaft or pin that replaces an otherwise featureless firearm assembly pin for retention, while preventing thumb rest rotation with the parallel insertion of a protruding stop into a neighboring cavity or channel in the receiver addresses issues described above, in accordance with embodiments of this disclosure. During the assembly of a firearm, a retaining pin such as a trigger pin, locking block pin, or other connecting pin would have a protruding end piece in the form of a thumb rest. To prevent rotation and to lock the thumb rest in place for the thumb to push solidly against, the thumb rest would have a second protrusion in the form of an anti-rotation stop extending from the thumb rest, parallel to the pin. This protrusion can take any shape or form as to mate with a receiving recess in the firearm's frame, such as a sidewall cavity intended to maintain the receiver's wall thickness when working with the flow control of a polymer injection mold, metal injection mold, or forging during manufacturing, as an aid in material filling, thermal cooling to reduce warpage, or add strength through the displacement of material. Other recesses may take the form of CNC Machined lightening cuts to reduce weight or for cosmetic purposes that would otherwise not be used for other purposes. Or utilize a portion of a channel that is normally reserved for a sliding disassembly catch to takedown the pistol as to release the slide assembly. The obstructing use of which would impede the motion of a typical spring-loaded catch and prevent disassembly until the thumb rest assembly pin is pushed out far enough to allow the neighboring anti-rotation stop to clear the channel. While an unused recess is ideal, the use of and impedance of the disassembly channel typically does not affect weapons usage. Disassembly when in active use is usually only required when there is a catastrophic failure, such as a squib load that obstructs the barrel with an undercharged bullet getting stuck, or during cleaning and maintenance at all other times. Either of which requires the use of tools and a steel punch would be typically used to push the pin out enough to clear the channel and a rod to clear stuck bullets.

One benefit of the simultaneous use of using this thumb rest assembly pin with an anti-rotation stop is the installation of a thumb rest that would normally be impossible, without damaging or adding bulk to the pistol. Another benefit of using a single assembly pin with anti-rotation stop, is that disassembly applies pressure to only one pin, opposed to a thumb rest that is bridged between two assembly pins. The former creates stress when there are two friction-fit pins and only one pin can be removed, typically with the hammering of a punch tool on the opposite side of the firearm, one-at-a-time, causing torsion in said part and greater difficulty in removal.

Other systems, methods, features, and advantages of the present disclosure will be or become apparent to one of ordinary skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Aspects of this disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION

The illustrations and diagrams in the Figures illustrate the architecture, functionality, and operation of possible implementations of systems according to various embodiments of the present invention.

Figure 1:
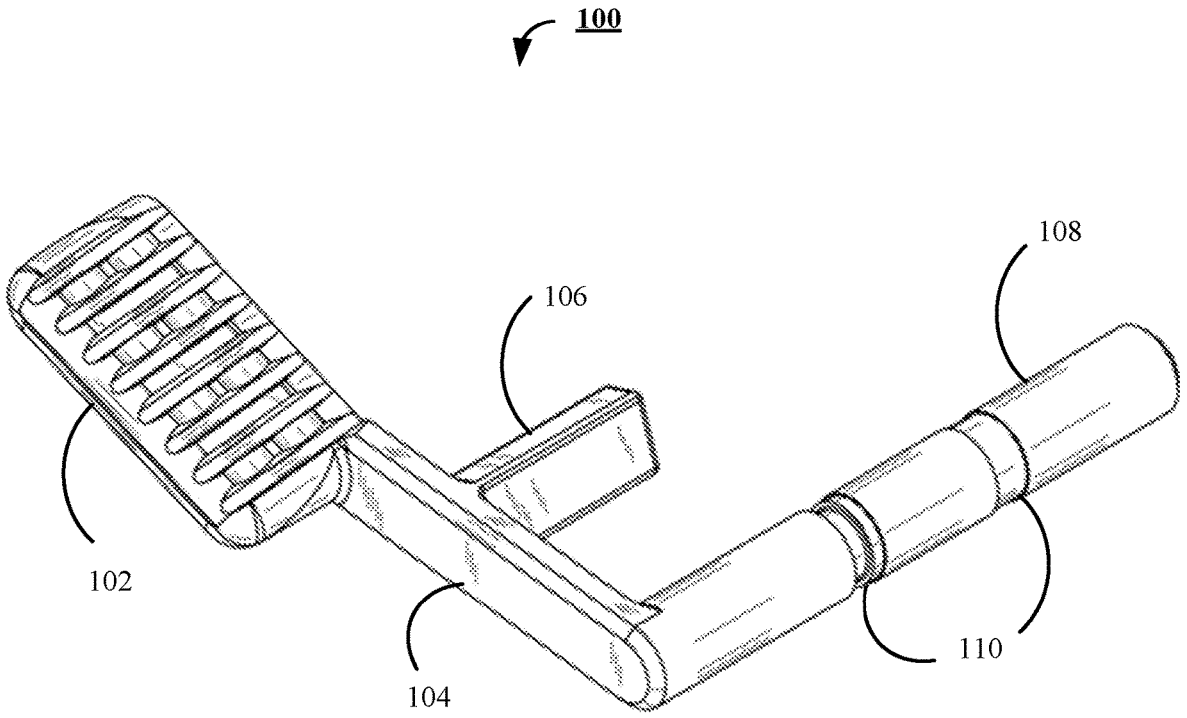
FIG. 1 is a top, rear, left-side perspective view of a first embodiment of a ledged takedown (LT) lever for a pistol in accordance with the disclosed subject matter.

FIG. 1 is a top, rear, left-side perspective view of a first embodiment of a ledged takedown (LT) lever 100 for a pistol in accordance with the disclosed subject matter. LT lever 100 includes a thumb rest, or base, 102, a bridge 104, a protruding component, or anti-rotation pin 106, an elongated pin, or a pistol assembly pin (PAP) 108 and PAP retaining grooves 110. LT lever 100 may be made from a polymer or metal material, such as steel with a form of corrosion protection inherent to the material or applied externally as a surface treatment or coating during manufacture. LT lever 100 may be made through traditional manufacturing methods, such as injection molding, ultraviolet (or other light) curing of polymers, thermal curing of polymers, milling/machining (CNC) bar stock, Metal Injection Molding (MIM), casting, forging, 3D printing, Additive Manufacturing (AM), or the like, or any other manufacturing method or combination of methods, to make similar components, as would be understood by one of ordinary skill in the art having the benefit of this disclosure. The installation, retention, and internal design features of the disclosed magazine release may be dictated by the original equipment manufacturer, as would be understood by one of ordinary skill in the art of firearm magazine releases having the benefit of this disclosure. Thumb rest 102, bridge 104, anti-rotation pin 106, PAP 108 and PAP retaining grooves 110 are explained in more detail below in conjunction with FIGS. 2-6.

LT lever 100 as disclosed herein provides an anti-rotation thumb rest installation ability that would otherwise not typically be available for certain models of firearms. The disclosed subject matter also enables an operator of a firearm to gain more grip control on the firearm. Considering that a gripping hand(s) of a pistol generally acts as a fulcrum point for rotational yaw due to recoiling torque and muzzle rise from a reciprocating slide mass and muzzle blast upon firing the firearm (which gets magnified further away from the hand), these enhancements may also assist in minimizing the firearm's lifting muzzle flip during recoil.

Figure 2:
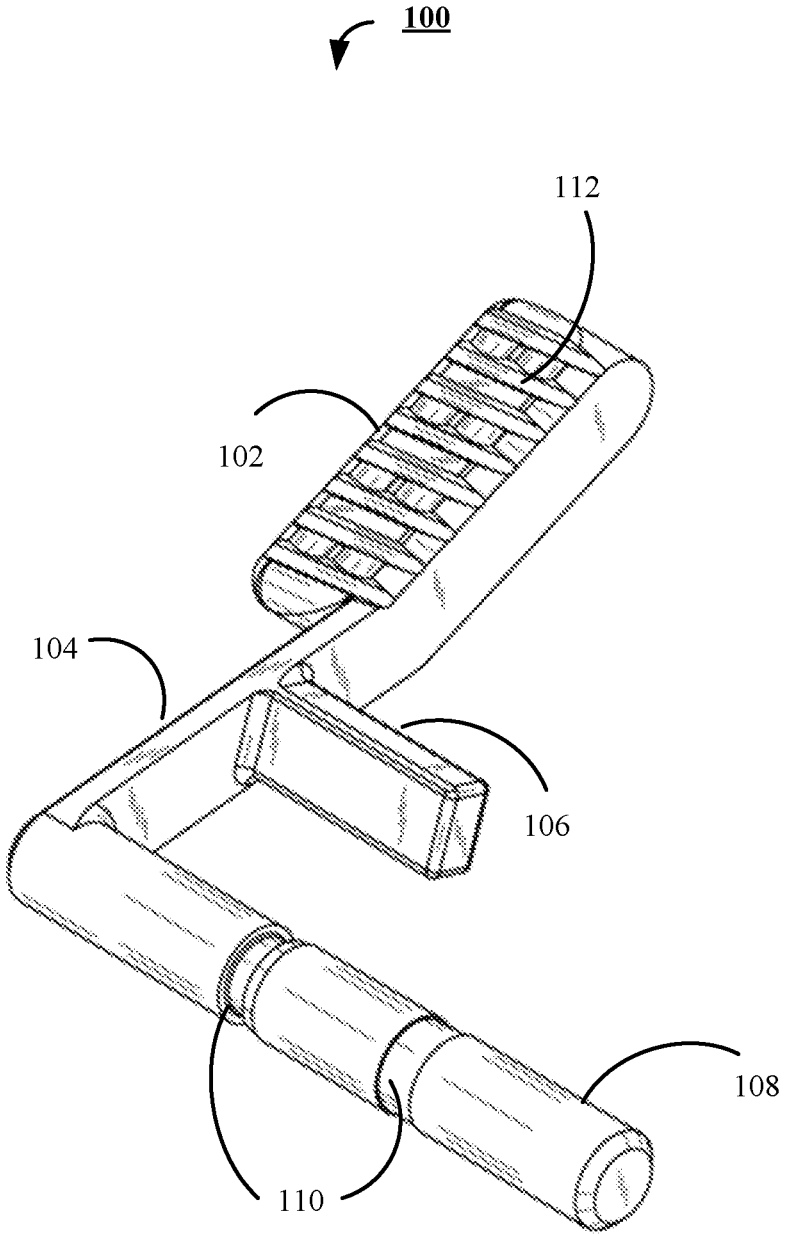
FIG. 2 is a top, rear, right-side perspective view of the LT lever introduced in FIG. 1.

FIG. 2 is a top, rear, right-side perspective view of LT lever 100 introduced in FIG. 1. Like FIG. 1, FIG. 2 includes thumb rest 102, bridge 104, anti-rotation pin 106, PAP 108 and PAP retaining grooves 110. FIG. 2 also shows thumb rest serrations 112 on the upper surface of thumb rest 102 that mitigate any slippage that might occur for an operator.

Figure 3:
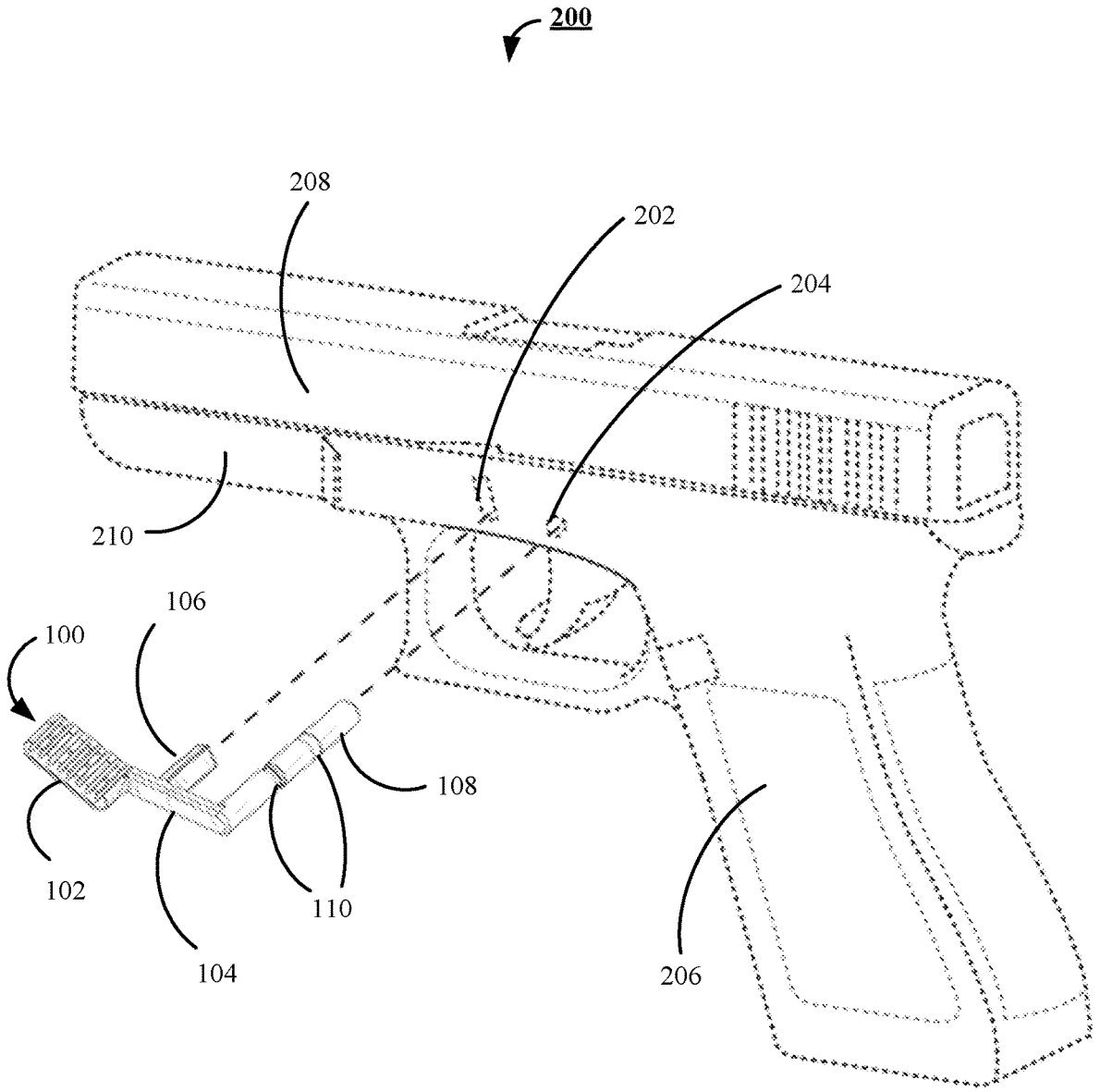
FIG. 3 is a top, rear, left-side perspective view of the LT lever shown in FIGS. 1-2, un-installed, in relation to a pistol.
Figure 7:
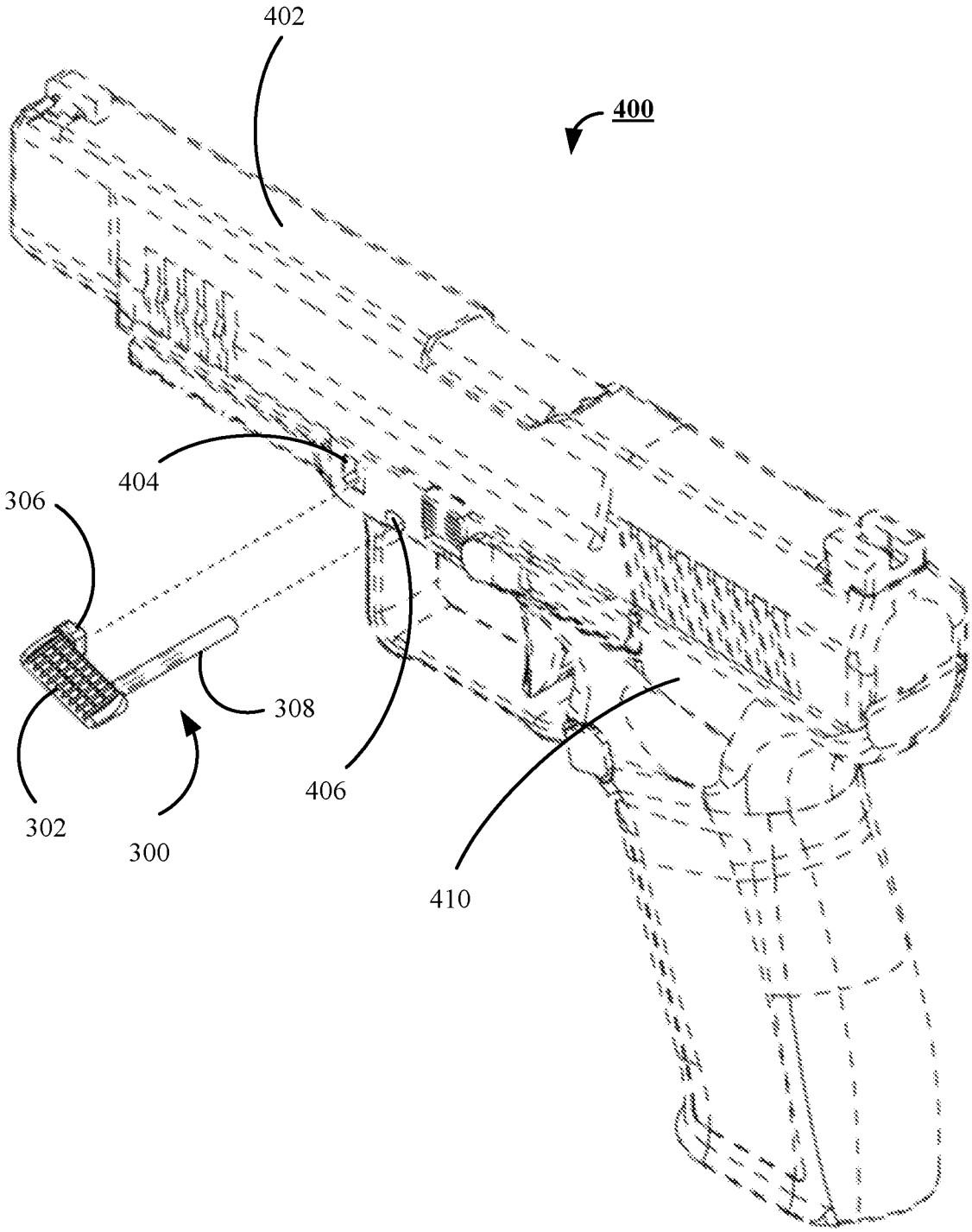
FIG. 7 is a top, rear, left-side perspective view of the LT lever shown in FIG. 6, un-installed, in relation to a pistol.

FIG. 3 is a view of LT lever 100 shown in FIGS. 1 and 2, un-installed, in relation to a pistol 200. LT lever 100 includes thumb rest 102, bridge 104, anti-rotation pin, or anti-rotation stop, 106, PAP 108, and retaining grooves 110. Dashed lines in FIGS. 3 and 7 illustrate LT lever's positioning with respect to pistol 200 and 400 respectively. Anti-rotation pin 106 fits into an anti-rotation stop recess 202 and PAP 108 fits into a PAP hole 204 in pistol 200, which is also outlined in FIG. 3 and subsequent figures with dashed lines. PAP 108 replaces a typically long cylindrical pin (not shown) the fits into PAP hole 204 and serves as a trigger pin, locking block pin, or other pin for securing pistol components internally together. When PAP pin 108 is inserted into PAP hole 204, internal firearm components (not shown) may be fastened onto PAP retaining grooves 110 to prevent PAP pin 108 from moving relative to pistol 200. PAP retaining grooves may be omitted in some embodiments for use in firearms that only use friction to retain a PAP pin.

Also illustrated is a grip module 206, slide assembly 208 and receiver 210 of pistol 200. Anti-rotation stop 106 is a protrusion that may have a rectangular, square, circular or irregularly cross-section and is adapted to fit into otherwise unobstructed recess 202 in receiver 210 of pistol 200. Recess 202 may be a sidewall cavity intended to maintain the thickness of a wall of receiver 210 when working with flow control of a polymer injection mold, metal injection mold or forging during manufacture, as an aid in material filing, thermal cooling to reduce warpage or add strength through the displacement of material. Recess 202 may also utilize a channel such as one normally reserved for a sliding disassembly catch (not shown) to takedown pistol 200 as to release slide assembly 208.

Figure 4:
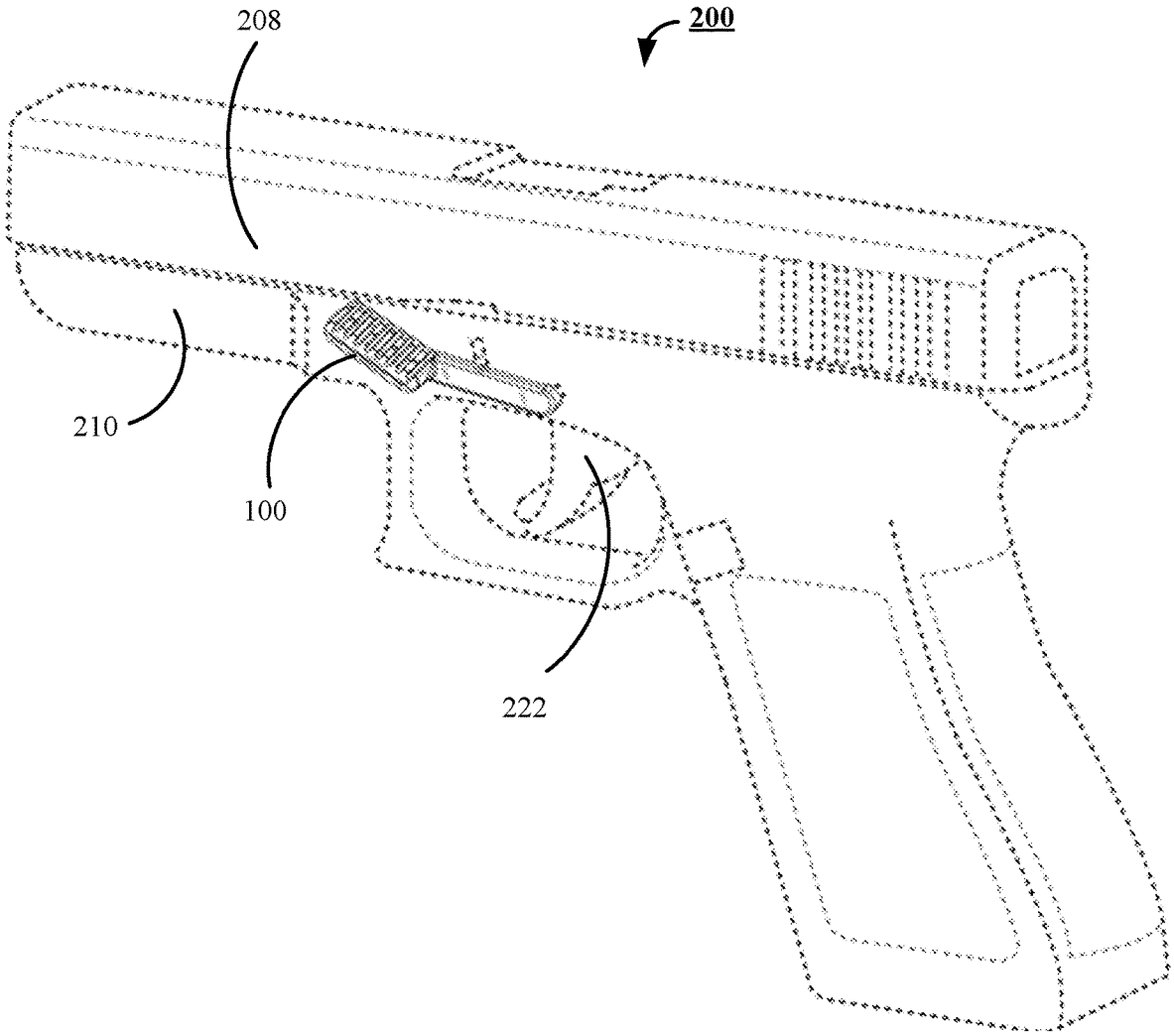
FIG. 4 is a top, rear, left-side perspective view of the LT lever shown in FIGS. 1-3 installed in a pistol.

FIG. 4 is view of LT lever 100 shown in FIGS. 1-3 installed in pistol 200 (FIG. 3), which includes a trigger 222, slide assembly 208 (FIG. 3) and receiver 210 (FIG. 3). Although not visible in FIG. 4, anti-rotation pin 106 is inserted into anti-rotation stop recess 202 and PAP pin 108 is inserted into PAP hole 204 and secured by clips inserted in PAP retaining grooves 110 (FIGS. 1-3), by friction or by mating internal parts (not shown).

Figure 5:
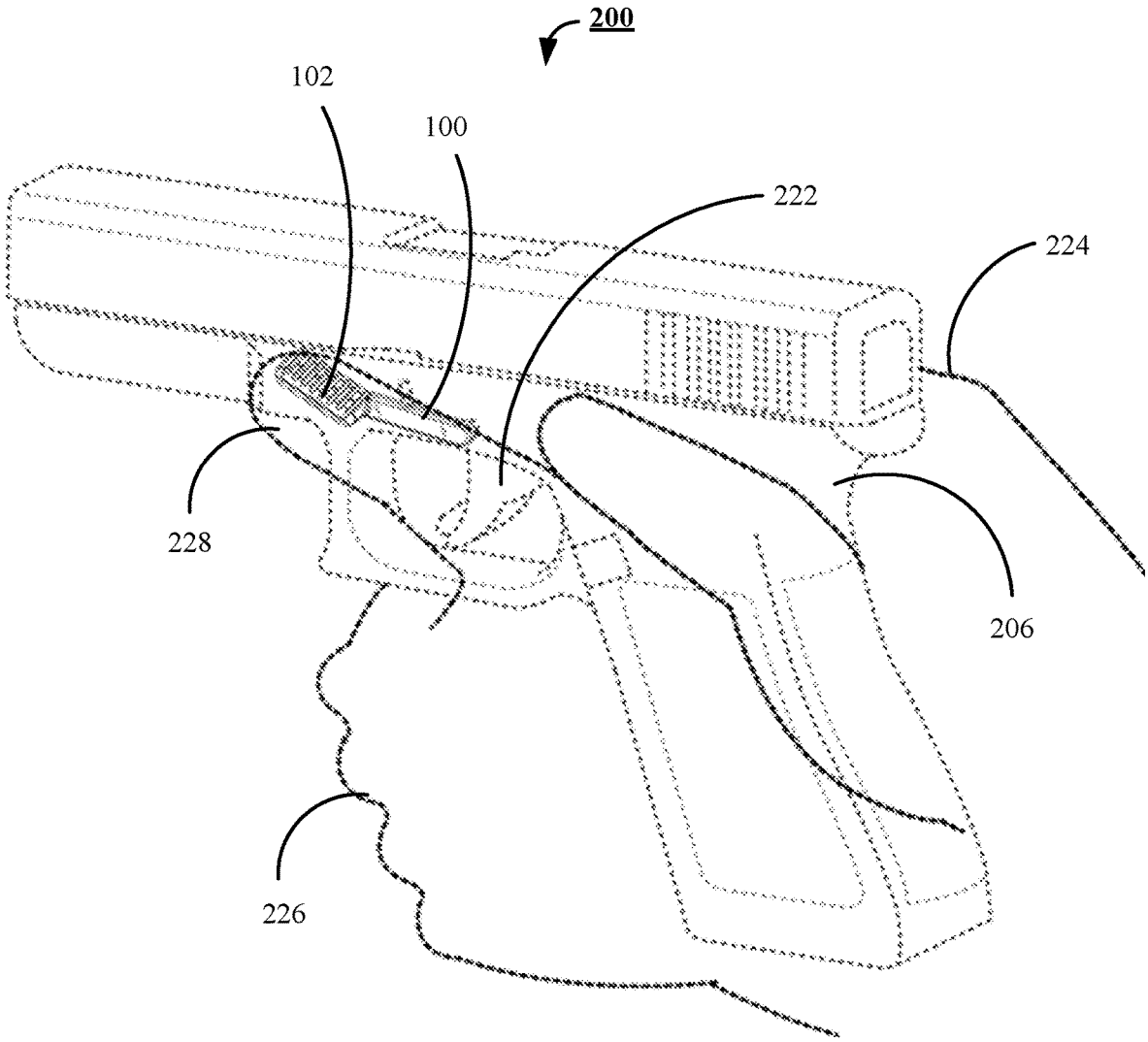
FIG. 5 is an illustration of the pistol of FIGS. 4 and 5 and the LT lever of FIGS. 1-4 while the pistol is griped by a person.

FIG. 5 is an illustration of pistol 200 of FIGS. 4 and 5 and LT lever 100 of FIGS. 1-4 while pistol 200 is griped by a person. LT lever 100 includes thumb rest 102 (FIGS. 1-3) and pistol 200 includes grip module 206 (FIG. 3) and trigger 222 (FIG. 4). A right hand 224 of a person is holding grip module 206 of pistol 200, typically with a right index finger (not shown) on trigger 222. The left hand 226 of the person is also holding grip module 206 with a left thumb 228 resting on thumb rest 102. The pressure of left thumb 228 on thumb rest 102 mitigates recoiling torque and muzzle rise from a reciprocating slide 208 mass and muzzle blast upon firing pistol 200. These enhancements may also assist in minimizing lifting muzzle flip of pistol 200 during recoil It should be understood that FIGS. 1-5 illustrate a configuration of LT lever 100 that is best suited for a person one who shoots right-handed. A mirrored version (not shown) of LT lever 100 may be provided for a left-handed person or shooter.

Figure 6:
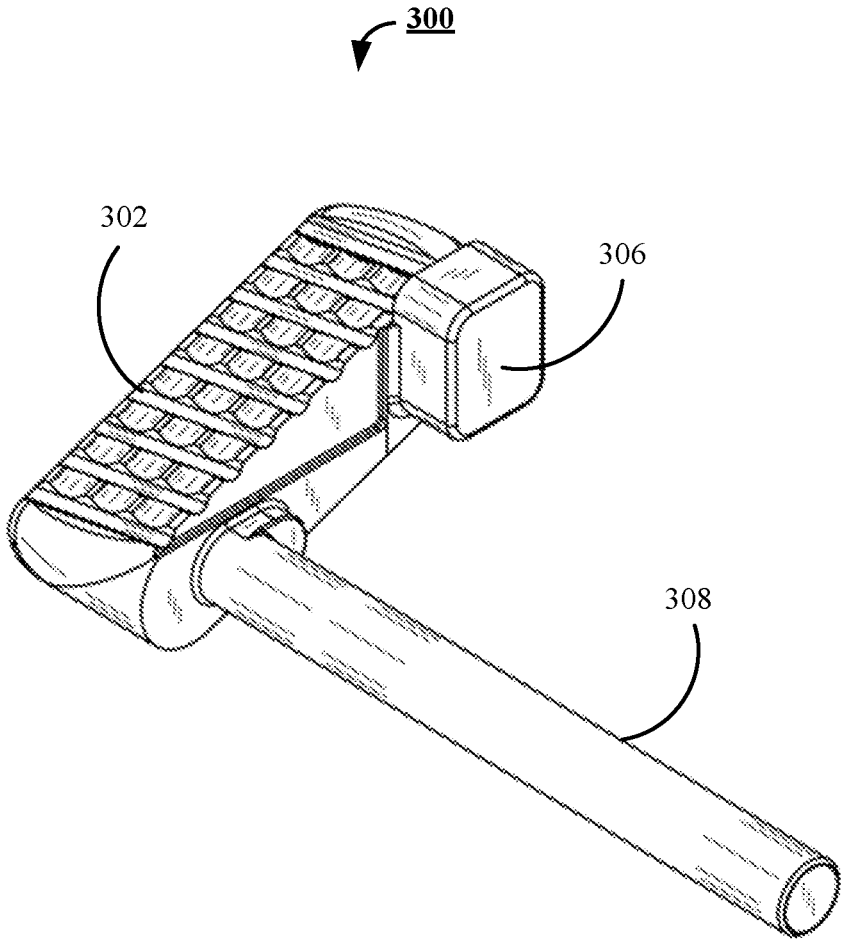
FIG. 6 is a top, rear, right-side perspective view of a second embodiment of an LT lever in accordance with the disclosed subject matter.

FIG. 6 is a top, rear, right-side perspective view of a second embodiment of an LT lever 300 in accordance with the disclosed subject matter. Like LT lever 100 (FIG. 1-5), LT lever 300 includes a thumb rest 302, an anti-rotation stop 306 and a PAP 308. In this embodiment, thumb rest 302 also functions as a bridge, like bridge 104 (FIGS. 1-2). Although shown, LT lever 300 may also include PAP retaining grooves like PAP retaining grooves 110 (FIGS. 1-3).

FIG. 7 is a top, rear, left-side perspective view of LT lever 300 shown in FIG. 6, un-installed, in relation to a pistol 400. Like in FIG. 6, also shown are thumb rest 302, anti-rotation stop 306 and PAP 308. Like pistol 200, pistol 400 includes a slide assembly 402, a receiver 410, a recess or cavity 404 and a PAP hole 406. Anti-rotation stop 306 (FIG. 6) fits into recess or cavity 404 and PAP 308 fits into PAP hole 406.

Figure 8:
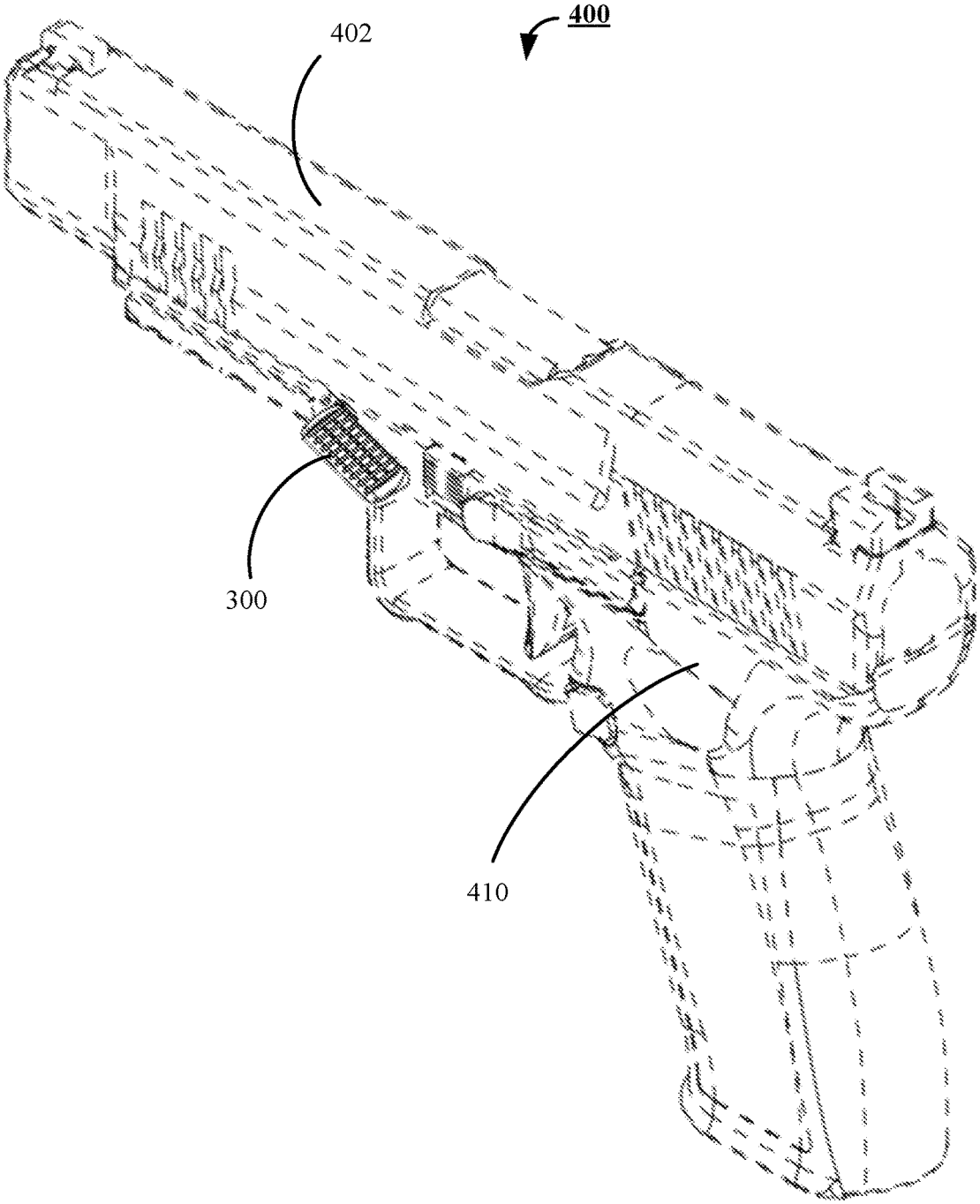
FIG. 8 is an illustration of the LT lever of FIGS. 6 and 7 installed in the pistol of FIG. 7.

FIG. 8 is an illustration of LT lever 300 of FIGS. 6 and 7 installed into receiver 410 (FIG. 7) of pistol 400 (FIG. 7). In FIG. 8, anti-rotation stop 306 (FIG. 6) fits into recess or cavity 404 and PAP 308 fits into PAP hole 406, all of which are obscured in FIG. 8.

The structures described above together create an anti-rotation thumb rest installation ability that would otherwise not typically be available to certain models of firearms. It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed:

1. A firearm thumb rest assembly for use with a firearm comprising:

a thumb rest;

a bridge coupled to the thumb rest;

a pistol assembly pin (PAP) coupled and orthogonal to the bridge and adapted to secure components of the firearm together; and an anti-rotation plug, coupled to the bridge proximally closer to the muzzle end of the pistol than the pistol assembly pin, and adapted to mate with a recess in a firearm receiver, wherein the PAP and anti-rotation plug are adapted to prevent all rotation of the thumb rest with respect to the firearm.

2. The firearm thumb rest assembly of claim 1, wherein the recess in the firearm receiver is a channel through the firearm receiver.

3. The firearm thumb rest assembly of claim 1, wherein the recess is an indentation in the firearm receiver.

4. The firearm thumb rest assembly of claim 1, wherein the bridge is an integral part of the thumb rest.

5. The firearm thumb rest assembly of claim 1, the PAP comprising a plurality of retaining grooves.

6. A firearm thumb support comprising:

a base;

a bridge couple to the base;

an elongated pin generally perpendicular to the bridge adapted to secure components of a firearm internally through the transverse axis of a receiver of the firearm; and a protruding component, proximally closer to the muzzle end of the pistol than the elongated pin, generally perpendicular to the bridge and adapted to secure the firearm thumb support in a fixed position with respect to the firearm-when inserted into a recess in the firearm receiver;

wherein the elongated pin and protruding component are adapted to prevent all rotation of the firearm thumb support with respect to the firearm.

7. The firearm thumb support of claim 6, wherein the recess in the firearm receiver is a channel through the firearm receiver.

8. The firearm thumb support of claim 6, wherein the recess is an indentation in the firearm receiver.

9. The firearm thumb support of claim 6, wherein the bridge is an integral part of the base.

10. The firearm thumb support of claim 6, the elongated pin comprising a plurality of retaining grooves.

11. A firearm, comprising:

a receiver;

a thumb rest;

a bridge coupled to the thumb rest;

a pistol assembly pin (PAP) coupled and orthogonal to the bridge and adapted to secure components of the firearm together; and an anti-rotation plug, coupled to the bridge proximally closer to the muzzle end of the pistol than the pistol assembly pin, and adapted to mate with a recess in a firearm receiver and to secure the firearm thumb rest assembly in a fixed position with respect to the firearm;

wherein the PAP and anti-rotation plug are adapted to prevent all rotation of the thumb rest with respect to the firearm.

12. The firearm of claim 11, wherein the recess in the receiver is a channel through the receiver.

13. The firearm of claim 11, wherein the recess is an indentation in the receiver.

14. The firearm of claim 11, wherein the bridge is an integral part of the thumb rest.

15. The firearm of 11, the PAP comprising a plurality of retaining grooves.

16. The firearm thumb rest assembly of claim 1, wherein the PAP is a trigger pin.

17. The firearm thumb rest assembly of claim 1, wherein the PAP is a locking block pin.

18. The firearm thumb support of claim 6, wherein the elongated pin is a trigger pin.

19. The firearm thumb support of claim 6, wherein the elongated pin is a locking block pin.

20. The firearm of claim 11, wherein the PAP is a trigger pin.

21. The firearm of claim 11, wherein the PAP is a locking block pin.

* * * * *